US009517814B2

(12) United States Patent
Robbins et al.

(10) Patent No.: US 9,517,814 B2
(45) Date of Patent: Dec. 13, 2016

(54) ADJUSTABLE FOOT BRACE FOR WATERCRAFT

(71) Applicant: Lifetime Products, Inc., Clearfield, UT (US)

(72) Inventors: Sam Robbins, South Ogden, UT (US); Edward VanNimwegen, North Ogden, UT (US)

(73) Assignee: LIFETIME PRODUCTS, INC., Clearfield, UT (US)

( * ) Notice: Subject to any disclaimer, the term of this patent is extended or adjusted under 35 U.S.C. 154(b) by 72 days.

(21) Appl. No.: 14/289,368

(22) Filed: May 28, 2014

(65) Prior Publication Data

US 2015/0122170 A1 May 7, 2015

Related U.S. Application Data

(60) Provisional application No. 61/899,708, filed on Nov. 4, 2013.

(51) Int. Cl.

| | |
|---|---|
| ***B63B 35/71*** | (2006.01) |
| ***B63B 17/00*** | (2006.01) |
| ***B63H 16/02*** | (2006.01) |

(52) U.S. Cl.

CPC ..... *B63B 17/00* (2013.01); *B63B 35/71* (2013.01); *B63H 16/02* (2013.01); *B63B 2035/715* (2013.01)

(58) Field of Classification Search

CPC ... B63H 16/02; B63B 35/71; B63B 2035/715; B63B 7/085

USPC ..... 114/363

See application file for complete search history.

(56) References Cited

U.S. PATENT DOCUMENTS

| | | | |
|---|---|---|---|
| 911,806 | A | 2/1909 | Broward |
| 2,079,871 | A | 5/1937 | Price |
| 2,126,106 | A | 8/1938 | Goldberg |
| 2,701,089 | A | 2/1955 | Fischer |
| 3,343,659 | A | 9/1967 | Marondel |
| 3,372,813 | A | 3/1968 | Ishida |
| 3,387,325 | A | 6/1968 | Sonneborn et al. |
| 3,860,305 | A | 1/1975 | Bergman |

(Continued)

FOREIGN PATENT DOCUMENTS

| | | |
|---|---|---|
| JP | 61-169883 | 10/1986 |
| WO | PCT/US14/40519 | 10/2014 |
| WO | PCT/US14/40519 | 12/2014 |

OTHER PUBLICATIONS

Sea Kayaking—http://seakayakphoto.blogspot.com/2013/10/malin-gometra-sea-kayak-long-term-test.html, Aug. 12, 2014.

(Continued)

*Primary Examiner* — Andrew Polay
(74) *Attorney, Agent, or Firm* — Workman Nydegger

(57) ABSTRACT

In one example, a watercraft is provided that includes a hull, and a cockpit connected to the hull. Disposed within the cockpit are first and second adjustable foot braces that are connected to the hull. Each of the adjustable foot braces is operable to define a variety of different foot positions. As well, the adjustable foot braces are each operable with a respective adjustment rod, and a structural configuration of each of the adjustable foot braces is the same regardless of whether the respective adjustment rod is present or not.

12 Claims, 7 Drawing Sheets

(56) References Cited

U.S. PATENT DOCUMENTS

| | | | | |
|---|---|---|---|---|
| 3,863,829 | A | 2/1975 | Merrill | |
| 4,066,032 | A | 1/1978 | Travis | |
| 4,229,850 | A | 10/1980 | Arcouette | |
| 4,483,380 | A | 11/1984 | Beran | |
| 4,556,003 | A | 12/1985 | Prade | |
| 4,589,365 | A | 5/1986 | Masters | |
| 4,660,490 | A | 4/1987 | Broadhurst | |
| 4,744,327 | A | 5/1988 | Masters | |
| 4,802,708 | A | 2/1989 | Vos et al. | |
| D308,662 | S | 6/1990 | Darby | |
| 4,942,840 | A * | 7/1990 | Masters | B63H 16/02 114/347 |
| 5,042,416 | A | 8/1991 | Arcouette | |
| 5,061,215 | A | 10/1991 | Walls | |
| 5,131,875 | A | 7/1992 | Lee | |
| 5,356,201 | A | 10/1994 | Olson | |
| D352,266 | S | 11/1994 | Niemier | |
| D352,689 | S | 11/1994 | Niemier | |
| 5,377,607 | A | 1/1995 | Ross | |
| 5,397,525 | A | 3/1995 | Niemier | |
| 5,405,002 | A | 4/1995 | Troia | |
| 5,415,343 | A | 5/1995 | Vosbikian | |
| 5,425,325 | A | 6/1995 | Washio | |
| D364,139 | S | 11/1995 | Niemier | |
| 5,493,982 | A | 2/1996 | Carpenter et al. | |
| 5,573,115 | A | 11/1996 | Fuller | |
| D377,473 | S | 1/1997 | Niemier | |
| 5,662,505 | A | 9/1997 | Spriggs | |
| D390,527 | S | 2/1998 | Niemier | |
| D391,916 | S | 3/1998 | Masters | |
| D394,630 | S | 5/1998 | Lincoln | |
| 5,810,177 | A | 9/1998 | Cabiran | |
| D400,843 | S | 11/1998 | Niemier | |
| 5,842,566 | A | 12/1998 | White | |
| 5,964,177 | A | 10/1999 | Niemier | |
| 6,035,801 | A | 3/2000 | Addison | |
| 6,112,692 | A | 9/2000 | Lekhtman | |
| 6,132,267 | A | 10/2000 | Campbell | |
| 6,152,063 | A | 11/2000 | Niemier | |
| 6,178,912 | B1 | 1/2001 | Niemier | |
| 6,210,242 | B1 | 4/2001 | Howard et al. | |
| 6,289,838 | B2 | 9/2001 | Dust | |
| 6,315,177 | B1 | 11/2001 | Weatherall | |
| 6,325,014 | B1 | 12/2001 | Blanchard | |
| 6,427,842 | B1 | 8/2002 | Green | |
| 6,523,492 | B1 * | 2/2003 | Neckar | B63H 16/02 114/347 |
| 6,561,118 | B2 | 5/2003 | Mead | |
| 6,669,516 | B1 | 12/2003 | Husted et al. | |
| 6,681,968 | B2 | 1/2004 | Zwagerman | |
| 6,718,905 | B1 | 4/2004 | Peerson et al. | |
| 6,736,084 | B2 | 5/2004 | McDonough et al. | |
| 6,739,276 | B1 | 5/2004 | Rard | |
| 6,739,277 | B2 * | 5/2004 | Knight | B63B 17/00 114/347 |
| 6,745,716 | B2 | 6/2004 | Belyeu | |
| 6,755,145 | B2 | 6/2004 | Bolebruch | |
| 6,837,378 | B2 | 1/2005 | Mason et al. | |
| 6,863,014 | B2 | 3/2005 | Hudson et al. | |
| 6,874,442 | B1 | 4/2005 | McDonough | |
| 6,880,481 | B2 | 4/2005 | Dunn et al. | |
| 6,923,137 | B2 | 8/2005 | Waits, Jr. | |
| 6,964,243 | B1 | 11/2005 | Thompson | |
| 6,990,920 | B2 | 1/2006 | Hamilton et al. | |
| 7,021,234 | B1 | 4/2006 | Belyeu | |
| 7,032,531 | B1 | 4/2006 | Caples | |
| D544,824 | S | 6/2007 | Eckert | |
| 7,320,291 | B2 | 1/2008 | Eckert | |
| 7,370,596 | B2 | 5/2008 | Warren | |
| 7,523,598 | B1 | 4/2009 | Eckert | |
| 7,735,442 | B2 | 6/2010 | Richter | |
| 7,887,381 | B2 | 2/2011 | Brass et al. | |
| 7,987,654 | B1 | 8/2011 | Eckert | |
| 2002/0109251 | A1 | 8/2002 | Sellepack | |
| 2002/0166493 | A1 | 11/2002 | Sorensen | |
| 2003/0003825 | A1 | 1/2003 | Keller | |
| 2003/0106835 | A1 | 6/2003 | Hubbs et al. | |
| 2004/0255828 | A1 | 12/2004 | Markling et al. | |
| 2005/0241562 | A1 | 11/2005 | Nysether et al. | |
| 2006/0060125 | A1 | 3/2006 | Pentecost | |
| 2006/0254495 | A1 * | 11/2006 | Eckert | A45F 4/02 114/347 |
| 2007/0017431 | A1 | 1/2007 | Hopkins | |
| 2008/0236471 | A1 | 10/2008 | Mott | |
| 2009/0038526 | A1 | 2/2009 | Walton | |
| 2009/0064917 | A1 | 3/2009 | Mackereth | |
| 2010/0009579 | A1 | 1/2010 | Wood | |
| 2012/0017821 | A1 | 1/2012 | McDonough | |
| 2013/0074760 | A1 | 3/2013 | VanNimwegen et al. | |
| 2013/0340669 | A1 | 12/2013 | VanNimwegen et al. | |

OTHER PUBLICATIONS

EMSCO Group, Voyager Family Recreation Kayak Marketing Brochure, Aug. 9, 2004 (2 pages).

Dragonfly Innovations,Moorea Marketing Brochure, Aug. 9, 2005 (1 page).

Emotion Kayaks—Fishing Kayaks, www.emotionkayaks.com/fishing-kayaks/, Jun. 18, 2012 (1 page).

Emotion Kayaks—Sit-On-Top Kayaks, www.emotionkayaks.com/sit-on-top/, Jun. 18, 2012 (1 page).

Emotion Kayaks—Parts, www.emotionkayaks.com/gear/parts.php, Jun. 18, 2012 (3 pages).

Emotion Kayaks—Sit Inside Kayaks, www.emotionkayaks.com/sit-inside/, Jun. 18, 2012.

International Preliminary Report on Patentability dated Mar. 25, 2014 from International Patent Application No. PCT/US2012/056630 filed Sep. 21, 2012.

International Search Report and Written Opinion dated Jan. 2, 2013 from International Patent Application No. PCT/US2012/056630 filed Sep. 21, 2012.

U.S. Appl. No. 14/013,624, Feb. 18, 2015, Office Action.

Notice of Allowance dated Jan. 15, 2009 from U.S. Appl. No. 11/688,361, filed Mar. 20, 2007.

Office Action dated Apr. 18, 2008 from U.S. Appl. No. 11/688,361, filed Mar. 20, 2007.

Notice of Allowance dated Feb. 1, 2011 from U.S. Appl. No. 12/431,613, filed Apr. 28, 2009.

Office Action dated Jul. 16, 2010 from U.S. Appl. No. 12/431,613, filed Apr. 28, 2009.

Office Action dated Mar. 18, 2008 from U.S. Appl. No. 11/591,184, filed Oct. 31, 2006.

Office Action dated Apr. 5, 2006 from U.S. Appl. No. 11/186,737, filed Jul. 21, 2005.

Office Action dated Apr. 4, 2011 from U.S. Appl. No. 12/538,645, filed Aug. 10, 2009.

Office Action dated May 26, 2011 from U.S. Appl. No. 12/538,822, filed Aug. 10, 2009.

Office Action dated Apr. 27, 2011 from U.S. Appl. No. 29/322,698, filed Aug. 8, 2008.

Office Action dated Aug. 20, 2010 from U.S. Appl. No. 29/322,698, filed Aug. 8, 2008.

Notice of Allowance dated Apr. 1, 2014 from U.S. Appl. No. 13/623,691, filed Sep. 20, 2012.

Office Action dated Jul. 5, 2013 from U.S. Appl. No. 13/623,691, filed Sep. 20, 2012.

Notice of Allowance dated Aug. 23, 2013 from U.S. Appl. No. 13/195,703, filed Aug. 1, 2011.

Office Action dated Jun. 6, 2013 from U.S. Appl. No. 13/195,703, filed Aug. 1, 2011.

Office Action dated Mar. 20, 2013 from U.S. Appl. No. 13/195,703, filed Aug. 1, 2011.

Notice of Allowance dated Aug. 24, 2006 from U.S. Appl. No. 29/234,705, filed Jul. 21, 2005.

Office Action dated Mar. 26, 2014 from U.S. Appl. No. 14/011,609, filed Aug. 27, 2013.

U.S. Appl. No. 11/186,737, filed Jul. 21, 2005.

U.S. Appl. No. 29/234,705, filed Jul. 21, 2005.

(56) References Cited

OTHER PUBLICATIONS

International Preliminary Report on Patentability of PCT/US2014/040519, dated May 19, 2016, filed Jun. 2, 2014.

* cited by examiner

ADJUSTABLE FOOT BRACE FOR WATERCRAFT

RELATED APPLICATION

This application claims the benefit of U.S. Provisional Patent Application Ser. No. 61/899,708, entitled ADJUSTABLE FOOT BRACE FOR WATERCRAFT, filed on Nov. 4, 2013. The aforementioned application is incorporated herein in its entirety by this reference.

FIELD OF THE INVENTION

The present invention generally relates to watercraft, examples of which include kayaks, canoes, row boats, rowing shells, paddleboats, and any other human-powered watercraft, suitable for use in water sports or other activities. More generally, one or more aspects of example embodiments may generally find application in any watercraft where one or more adjustable foot braces may be useful, and the scope of the invention is not limited to the example watercraft disclosed herein.

BACKGROUND

Users of a variety of different sizes may use watercraft for water sports and other activities. However, at least some of such watercraft may lack features that enable a user to readily modify the watercraft to accommodate the size of that particular user. Thus, a user may be compelled to use a watercraft having a fixed configuration that is not well suited to accommodate the size of that user. As well, prospective purchasers may be deterred from purchasing a watercraft that cannot be readily modified to accommodate a variety of users of different sizes.

In light of the foregoing, it would be useful to provide a watercraft configured to enable a user to at least partly customize the configuration of the watercraft so as to better accommodate the particular size of that user, and the sizes of various other users as well.

BRIEF SUMMARY OF ASPECTS OF SOME EXAMPLE EMBODIMENTS

Example embodiments are concerned with an adjustable foot brace that can be used in various types of watercraft. The embodiments disclosed herein do not constitute an exhaustive summary of all possible embodiments, nor does this summary constitute an exhaustive list of all aspects of any particular embodiment(s). Rather, this summary simply presents selected aspects of some example embodiments. It should be noted that nothing herein should be construed as constituting an essential or indispensable element of any invention or embodiment. Rather, and as the person of ordinary skill in the art will readily appreciate, various aspects of the disclosed embodiments may be combined in a variety of ways so as to define yet further embodiments. Such further embodiments are considered as being within the scope of this disclosure.

As well, none of the embodiments embraced within the scope of this disclosure should be construed as resolving, or being limited to the resolution of, any particular problem(s). Nor should such embodiments be construed to implement, or be limited to implementation of, any particular effect(s).

Finally, it should be understood that not all embodiments employ or require all of the elements disclosed herein. By way of illustration, the adjustment rod, discussed below, is optional and need not be employed in at least some embodiments of the adjustable foot brace.

Example embodiments within the scope of this disclosure may include, among other things, one or more of the following, in any combination: one or more adjustable foot braces that each define a plurality of different foot positions; an adjustable foot brace that is movable between two or more different foot positions; an adjustment mechanism for an adjustable foot brace; an adjustment rod for an adjustment mechanism of an adjustable foot brace; an adjustable foot brace that does not require or employ an adjustment rod; an adjustable foot brace that is universal such that it can be employed on either the left or right side of a watercraft; an adjustable foot brace that is releasably lockable in a plurality of different foot positions; an adjustable foot brace having a brace element whose position is adjustable by a translational movement of an adjustment rod engaged with the brace element; an adjustable foot brace having an adjustment rod operably engaged with a brace element, and the adjustment rod configured for reciprocal linear motion so as to enable adjustment of a position of the brace element in either of two opposing directions; an adjustable foot brace having an adjustment rod operably engaged with a brace element so that adjustment of the brace element by the adjustment rod is effected with only linear motion of the adjustment rod; an adjustable foot brace having a brace element; an adjustable foot brace having a brace element whose position can be adjusted and locked with or without an adjustment rod; an adjustable foot brace having a brace element whose position can be adjusted and locked substantially simultaneously; an adjustable foot brace having a brace element whose position can be adjusted and locked substantially simultaneously in response to a linear movement imparted to the brace element; a track that defines a plurality of discrete positions of a corresponding brace element of a foot brace; a latch connectible to a foot brace and operable to enable a change in the position of the brace element and/or to releasably lock the brace element in a desired position; a visual indicator for an adjustable foot brace, where the visual indicator shows the relative position of a brace element of an adjustable foot brace; one or more elements of an adjustable foot brace, the one or more elements individually and/or collectively comprising plastic, rubber, metals such as stainless steel or aluminum for example, fiberglass, carbon fiber, composite material, or any combination of the foregoing; a watercraft including any of the aforementioned foot braces and/or elements thereof, where some or all of the watercraft is implemented as a unitary one-piece structure; and, one or more tack-offs integral with a portion of a watercraft.

In a first example embodiment, an adjustable foot brace is provided that is suitable for use in a watercraft.

In a second example embodiment, an adjustable foot brace is provided that is suitable for use in a watercraft, and at least a portion of the adjustable foot brace is integral with the watercraft.

In a third example embodiment, an adjustable foot brace is provided that is suitable for use in a watercraft, and the adjustable foot brace includes a brace element that is movable between, and releasably lockable in, a plurality of different positions.

In a fourth example embodiment, an adjustable foot brace is provided that is suitable for use in a watercraft, the adjustable foot brace includes a brace element that is releasably lockable in a plurality of different positions, and the adjustable foot brace also includes a latch connected to the brace element and the latch is operable to enable a change in the position of the brace element and/or to releasably lock the brace element in a desired position.

In a fifth example embodiment, an adjustable foot brace is provided that is suitable for use in a watercraft, the adjustable foot brace includes a brace element and a track that defines a plurality of discrete positions for the brace element, and the adjustable foot brace further includes a latch connected to the brace element and configured to releasably engage the track, and the latch is operable to enable a change in the position of the brace element and/or to releasably lock the brace element in a position defined by the track.

In a sixth example embodiment, an adjustable foot brace is provided that is suitable for use in a watercraft, the adjustable foot brace includes a brace element that is releasably lockable in a plurality of different positions, and the adjustable foot brace also includes an adjustment rod that engages the brace element and is operable to effect a change in the position of the brace element without requiring, for example, any twisting or lifting of the adjustment rod.

In a seventh example embodiment, an adjustable foot brace is provided that is suitable for use in a watercraft, the adjustable foot brace includes a brace element that is releasably lockable in a plurality of different positions, and the adjustable foot brace also includes an adjustment rod that engages the brace element and is operable to effect a change in the position of the brace element, and the adjustment rod is configured such that a change in the position of the brace element can be effected by pulling or pushing the adjustment rod.

In an eighth example embodiment, an adjustable foot brace is provided that is suitable for use in a watercraft, the adjustable foot brace includes a brace element and a track that defines a plurality of discrete positions for the brace element, and the adjustable foot brace also includes a latch connected to the brace element and configured to releasably engage the track so as to enable a change in the position of the brace element and/or to releasably lock the brace element in a position defined by the track, and an adjustment rod is provided that engages the brace element and is operably disposed with respect to the latch such that the adjustment rod is operable to change the position of the brace element.

In a ninth example embodiment, an adjustable foot brace is provided that is suitable for use in a watercraft, the adjustable foot brace includes a brace element that is releasably lockable in a plurality of different positions, and the adjustable foot brace also includes an indicator that visually indicates a relative position of the brace element.

In a tenth example embodiment, an adjustable foot brace is provided that is suitable for use in a watercraft, the adjustable foot brace includes a brace element that is releasably lockable in a plurality of different positions, and the adjustable foot brace also includes an adjustment rod that engages the brace element and is operable to effect a change in the position of the brace element, and the adjustment rod indicates a relative position of the brace element.

In an eleventh example embodiment, a water craft is provided that includes any of the aforementioned embodiments of an adjustable foot brace.

In a twelfth example embodiment, a kayak is provided that includes any of the aforementioned embodiments of an adjustable foot brace.

In a thirteenth example embodiment, a watercraft is provided that includes any of the aforementioned foot braces and/or elements thereof, where some or all of the watercraft is implemented as a unitary one-piece structure.

In a fourteenth example embodiment, a kayak is provided that includes any of the aforementioned foot braces and/or elements thereof, where some or all of the kayak is implemented as a unitary one-piece structure and the kayak includes one or more tack-offs integral with a portion of the kayak.

In a fifteenth example embodiment, a kayak is provided that includes any of the aforementioned foot braces and/or elements thereof, where some or all of the kayak, such as the hull and/or cockpit for example, is implemented as a unitary one-piece structure comprising blow-molded plastic.

In a sixteenth example embodiment, an adjustable foot brace is provided that includes a latch configured such that movement of the latch to adjust and/or lock the position of an associated brace element can be effected either by the hand of a user or, alternatively, through the use of an adjustment rod, if an adjustment rod is present.

In a seventeenth example embodiment, an adjustable foot brace is provided that is configured to operate with an adjustment rod, but whose configuration and operation are the same regardless of whether an adjustment rod is present or not.

In an eighteenth example embodiment, an adjustable foot brace is provided that is configured to operate with an adjustment rod, and adjustment of a position of a brace element of the adjustable foot brace is effected with only a translational movement of the adjustment rod.

Any embodiment of the kayak or other water craft that includes a hull which is constructed at least partly of blow-molded plastic may have an interior that is partly, or completely, hollow. Such embodiments may also include, disposed in the interior, one or more depressions, sometimes referred to as "tack-offs." In such embodiments, these tack-offs may be integrally formed as part of a unitary, one-piece structure during the blow-molding process. The depressions may extend from a first surface, such as a first interior surface of the hull, towards a second surface, such as a second interior surface of the hull. The ends of one or more depressions may contact or engage the second surface, or the ends of one or more of the depressions may be spaced apart from the second surface by a distance. In some instances, one or more depressions on a first interior surface may be substantially aligned with corresponding depressions on a second interior surface, and one or more depressions on the first interior surface may contact one or more corresponding depressions on the second interior surface or, alternatively, one or more depressions on the first interior surface may be spaced apart from corresponding depressions on the second interior surface. In still other instances, depressions that contact each other and depressions that are spaced apart from each other may both be present in a kayak or other water craft. The depressions may be sized and configured to strengthen and/or reinforce the blow-molded plastic hull of the kayak or other water craft. Finally, the depression, or depressions, can be any shape or size, and depressions of different respective shapes and/or sizes can be combined in a single watercraft.

BRIEF DESCRIPTION OF THE DRAWINGS

The appended drawings contain figures of various example embodiments to further illustrate and clarify the above and other aspects of example embodiments of the present invention. It will be appreciated that these drawings depict only example embodiments of the invention and are not intended to limit its scope. The invention will be described and explained with additional specificity and detail through the use of the accompanying drawings in which.

DETAILED DESCRIPTION OF SOME EXAMPLE EMBODIMENTS

With reference now to the figures, details are provided concerning aspects of example adjustable foot braces that may be used in various types of watercraft. In particular, one or more adjustable foot braces can be used in a variety of watercraft, examples of which include kayaks, canoes, row boats, rowing shells, paddleboats, and any other human-powered watercraft, suitable for use in water sports or other activities.

A. Aspects of an Example Water Craft

Figure 1:
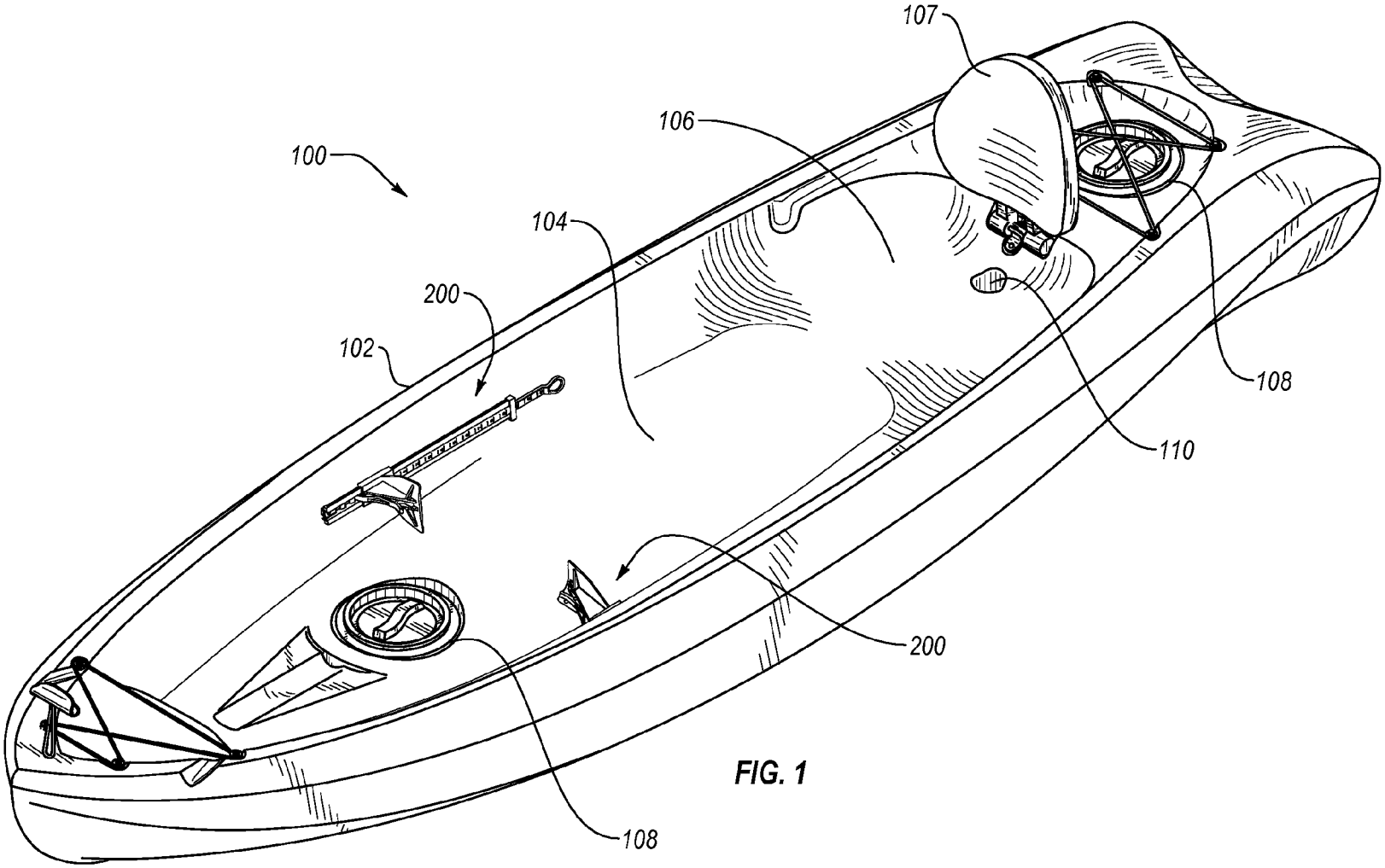
FIG. 1 is a front perspective view of an example water craft that includes an example adjustable foot brace.

With attention first to FIG. 1, a water craft 100, such as a kayak for example, is disclosed that includes a hull 102. In at least some embodiments, the hull 102 may be constructed partly, or completely, from blow-molded plastic in the form of a unitary, one-piece structure, and the hull 102 may define an interior that is partially, or substantially, hollow. In other embodiments, the hull 102 may be made of materials other than blow-molded plastic. As indicated in the example of FIG. 1, the hull 102 can be configured to include a variety of elements, which may be integrally formed with the rest of the hull 102, such as, but not limited to, a cockpit 104, one or more seating areas 106 and corresponding seat backs 107, one or more storage areas 108, and one or more tack offs 110.

With continued reference to FIG. 1, the water craft 100 includes one or more adjustable foot braces 200. In general, an adjustable foot brace 200 is located on either side of the cockpit 104, and positioned such that a user seated on the seating area 106 can place one of his feet on each of the foot braces 200. The adjustable foot braces 200 may be universal in the sense that different foot brace configurations are not required for the right and left sides of the cockpit 104. Instead, an adjustable foot brace 200 employed on one side of the cockpit 104 can be employed as easily on the other side of the cockpit 104. That is, both adjustable foot braces 200 of the water craft 100 may have substantially the same, or identical, construction as each other. This substantially similar, or identical, construction also enables the adjustable foot braces 200 to be used interchangeably with each other and may thus reduce manufacturing costs, and make the installation process easier.

The components of the foot braces 200 may be comprised of any suitable materials, examples of which are disclosed herein. In general, the foot braces 200 enable users to implement a degree of customization to the configuration of the water craft 100 such that the water craft 100 can be modified, for example, to accommodate users of a variety of different sizes. By way of illustration, the desired foot placement, in the water craft 100, of a user who is 5 feet tall, for example, may be quite different from the desired foot placement of a user who is 6 feet tall, for example. Notwithstanding that these two illustrative users are substantially different in height, the adjustable foot braces 200 enable each of such users to readily modify the configuration of the water craft 100 to suit their respective sizes.

B. Aspects of Some Example Foot Braces

Figure 2:
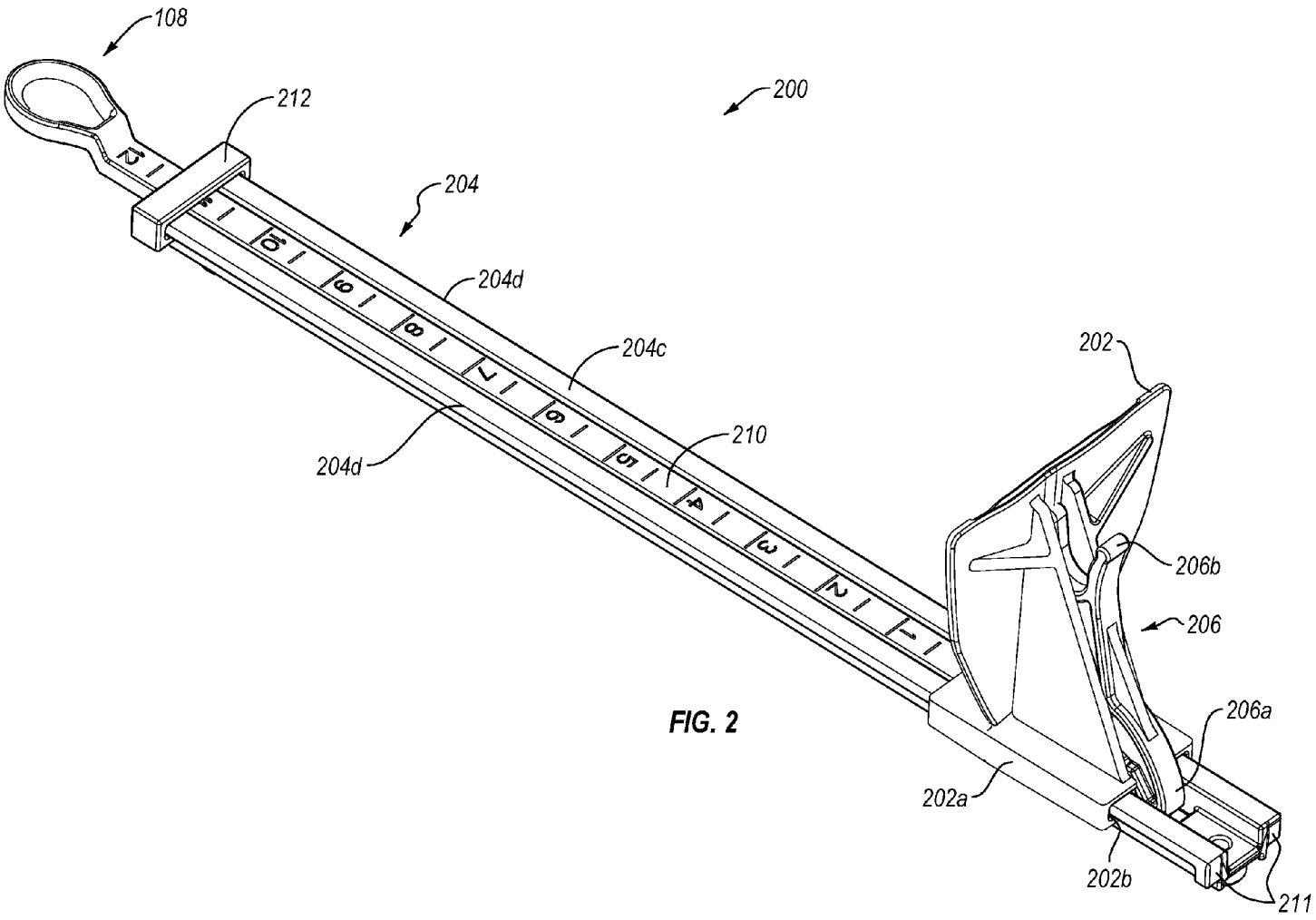
FIG. 2 is a top rear perspective view of an example adjustable foot brace.
Figure 3:
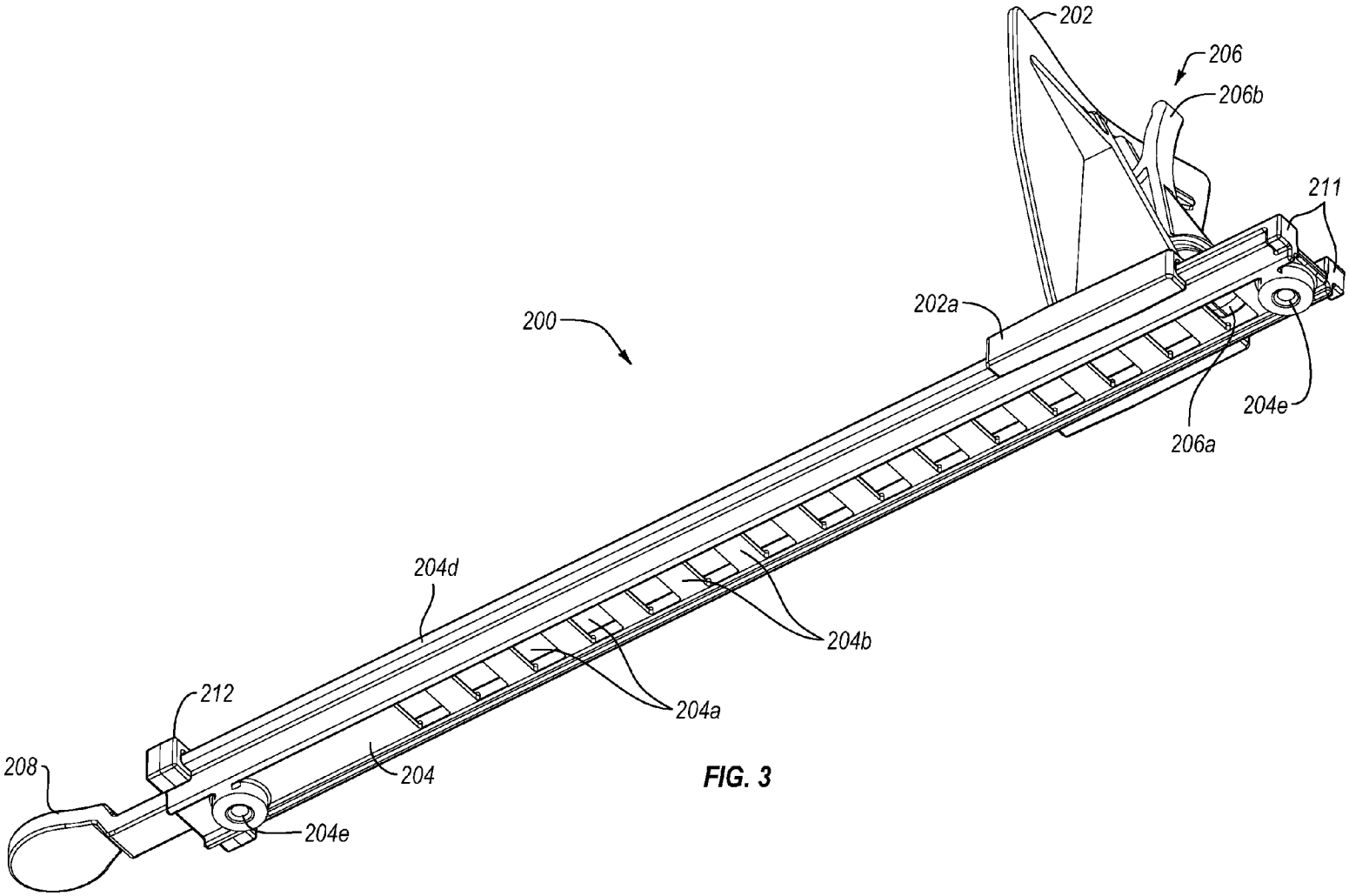
FIG. 3 is a bottom rear perspective view of an example adjustable foot brace.
Figure 4:
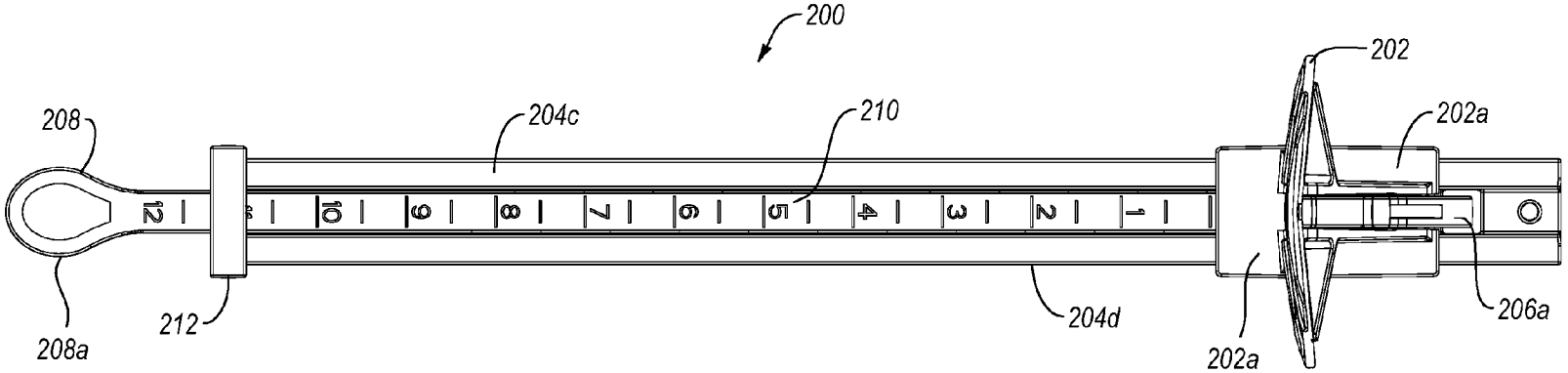
FIG. 4 is top view of an example adjustable foot brace.
Figure 5:
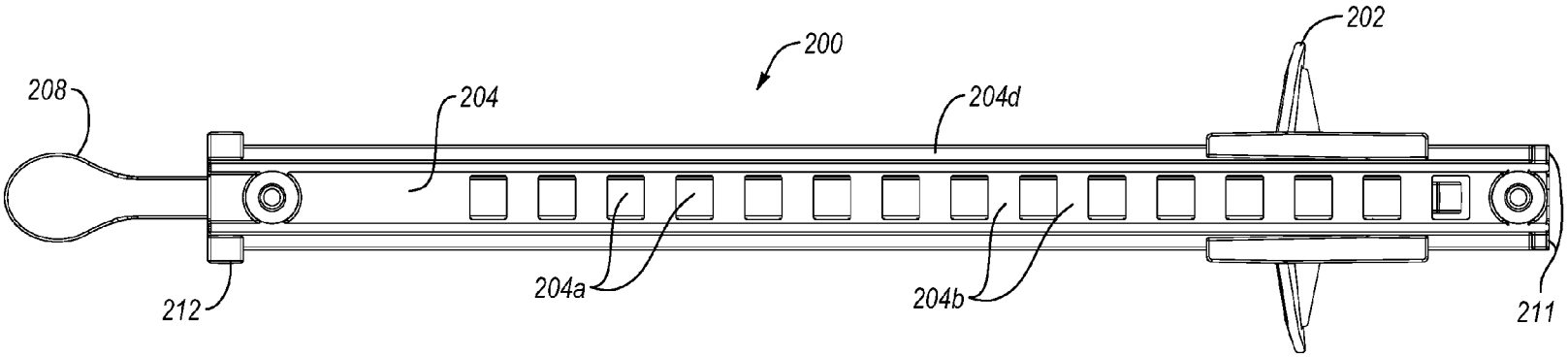
FIG. 5 is a bottom view of an example adjustable foot brace.
Figure 6:
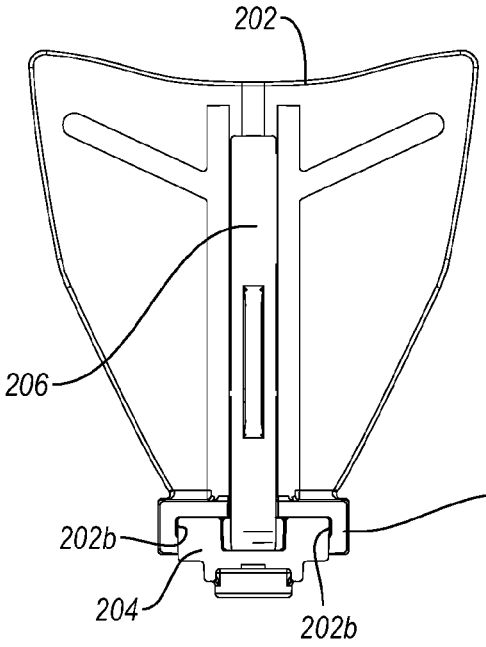
FIG. 6 is a rear view of a brace element of an example adjustable foot brace.
Figure 7:
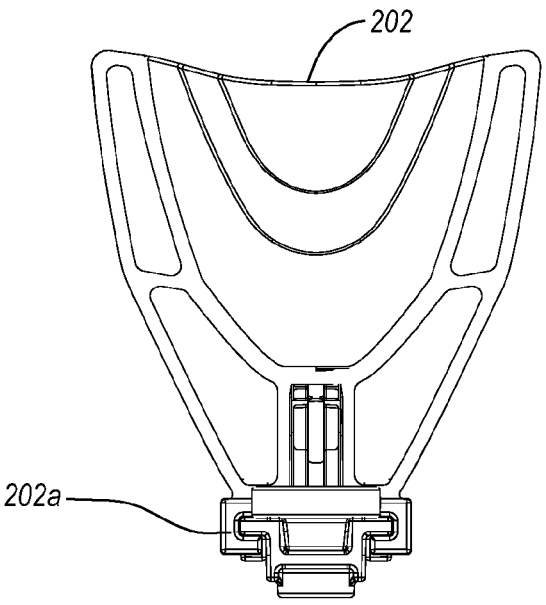
FIG. 7 is a front view of a brace element of an example adjustable foot brace.
Figure 8:
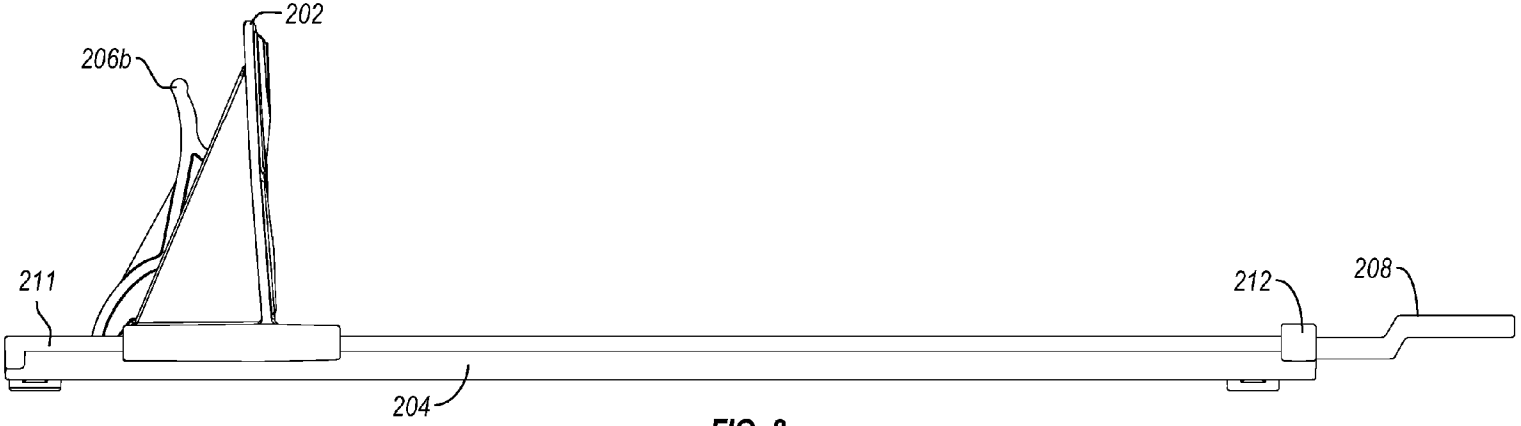
FIG. 8 is a right side view of a brace element of an example adjustable foot brace that includes an adjustment rod.
Figure 9:
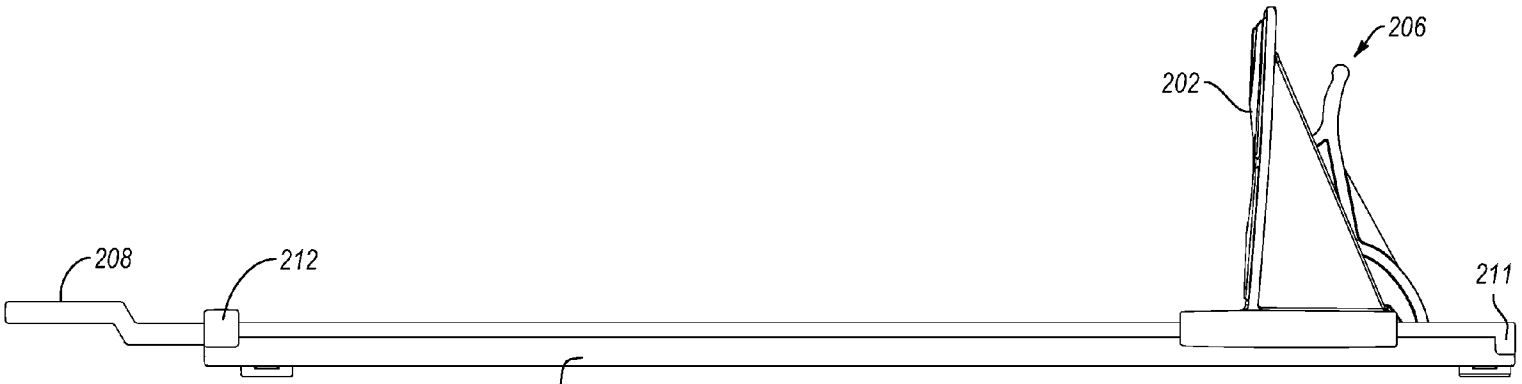
FIG. 9 is a left side view of a brace element of an example adjustable foot brace.

With reference now to FIGS. 2-11, example embodiments of the adjustable foot brace 200 may include a brace element 202 having a base 202*a* that defines a pair of channels 202*b*, each of which receives, and slidingly engages, a respective portion of a track 204. The brace elements 202 may optionally include, on the side facing the user, a non-slip surface treatment such as etching, ribbing, ridges, bumps, or cross-hatching for example, or a layer of material (not shown), coating, or cover, such as rubber for example, that has a relatively high level of friction which may help to prevent the foot of the user from slipping off the brace element 202, particularly when the foot of the user and/or the brace element 202 are wet. In some instances, the brace elements 202 may include straps (not shown), toe cups, or comparable devices to assist the user in securing his or her feet relative to the brace elements 202. As best shown in FIGS. 4 and 5, the brace element 202 may have a slightly convex configuration, where the convex side of the brace element 202 faces toward the user.

Figure 10:
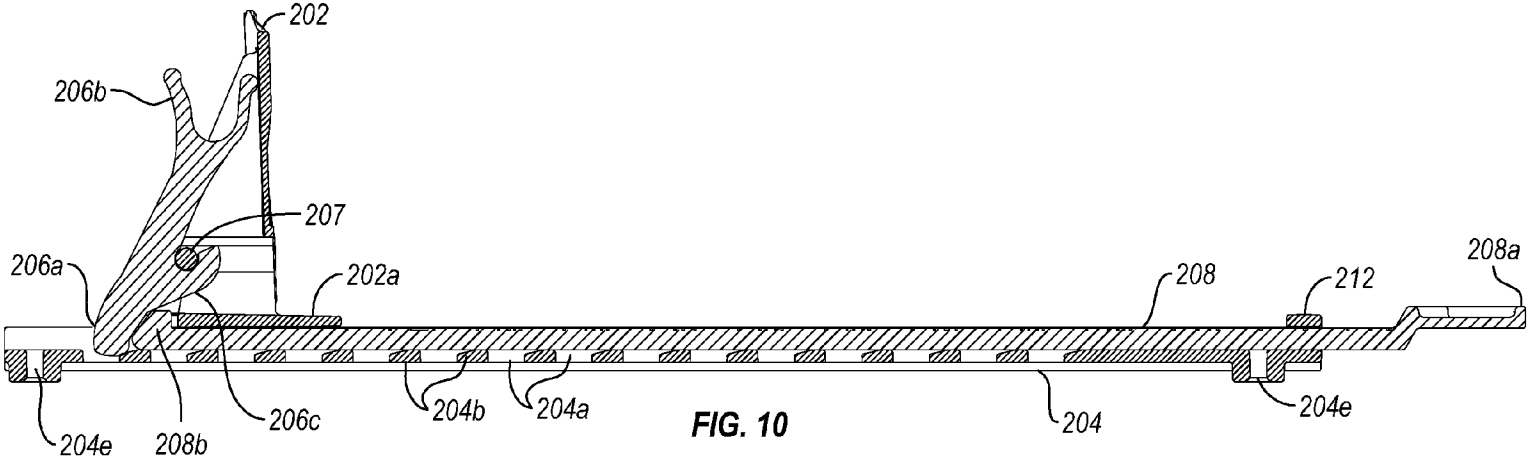
FIG. 10 is a section view of an example adjustable foot brace.
Figure 11:
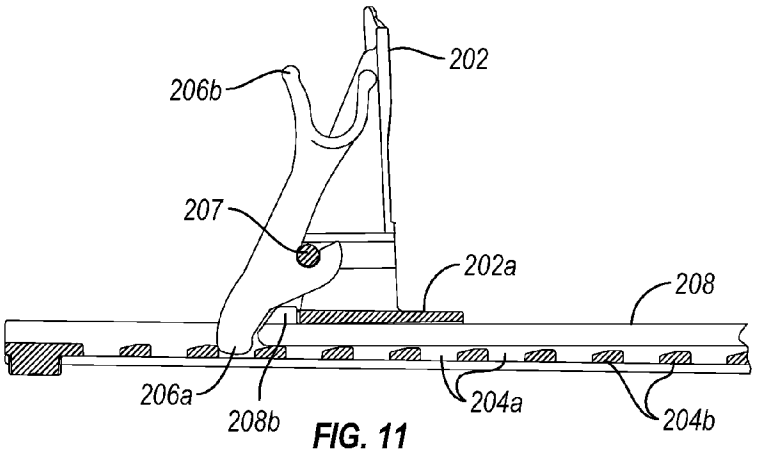
FIG. 11 is a partial section view of an example adjustable foot brace, and showing an adjustment rod and brace element.

A respective latch 206 is rotatably connected to each brace element 202 such that the latch 206 can rotate relative to the brace element 202. In the illustrated example, and as best shown in FIGS. 10 and 11, discussed below, the brace element 202 includes one or more pins 207 or other elements about which the latch 206 can rotate. The pins 207 may comprise metal, plastic, and/or any other suitable materials. In some embodiments, the pins 207 are configured to snap fit into corresponding structure of the latch 206. As disclosed in further detail elsewhere herein, the brace element 202 may be configured in such a way as to at least partly constrain the range of rotational motion of the latch 206. This constraint on the rotational range of motion of the latch 206 may be imposed cooperatively by the brace element 202 and one or more other elements of the adjustable brace 200.

As indicated in FIGS. 2 and 3, the latch 206 includes a tooth 206*a* configured to releasably engage a corresponding slot 204*a* defined by ties 204*b* of the track 204, where each slot 204*a* defines a respective brace element 202 position. The track 204 may be configured to define any number of slots 204*a*, depending upon considerations such as the extent to which the brace element 202 position is desired to be adjusted. Thus, some embodiments of the track 204 may define a relatively small number of brace element 202 positions, while other embodiments of the track 204 may define a relatively larger number of brace element 202 positions. In some example embodiments, the track 204 may define in a range of about 10 to about 15 different brace element 202 positions. As well, at least one end of the track 204 may include one or more stops 211 to prevent the brace element 202 from being moved off the end of the track 204.

With continued reference now to the latch 206, some embodiments of the latch 206 may include, in addition to the tooth 206*a*, a handle 206*b* that enables a user to manually rotate the latch 206, if desired. Further, and as best shown in FIGS. 10 and 11, the latch 206 includes an arm 206*c* that receives the pin(s) 207, in a snap fit or other suitable manner, as noted above such that the latch 206 is able to rotate about the pin(s) 207.

Optionally, the adjustable foot brace 200 may further include an adjustment rod 208 that may, but need not, include a visual indicator 210 (see, e.g., FIGS. 2 and 4) which indicates a relative position of an associated brace element 202. The visual indicator 210 can include numbers and/or any other markings which indicate a relative position of an associated brace element 202. Where an adjustment rod 208 is not employed, the visual indicator 210, if present, can be located in an alternative location, such as on an upper surface 204*c* of the track 204, for example.

The adjustment rod 208, when present, is slidingly received in the recessed inner portion of the track 204 above the slots 204*a* such that the adjustment rod 208 can slide back and forth between, while remaining laterally confined by, the sides 204*d* of the track 204. As shown in FIGS. 2, 4 and 10 for example, the adjustment rod 208 may include a loop 208*a* or similar structure to enable a user to readily grasp and operate the adjustment rod 208.

A stop 212 can be attached, permanently or removably, to the track 204 so as to prevent the brace element 202 from being pulled off the end of the track 204 by the adjustment rod 208, or by a user. The stop 212 may also help to prevent the adjustment rod 208, when present, from being lifted up out of its position in the recessed inner portion of the track 204. Finally, the stop 212 can serve as a point of reference for the visual indicator 210. For example, a user may recall that when the "7" on the visual indicator 210 is positioned at the stop 212, the brace element 202 is in the desired position for that user.

The adjustable foot braces 200 can be attached, either permanently or removably, in any suitable fashion. In some instances, and with particular reference to FIG. 3, the track 204 of the adjustable foot brace 200 defines a pair of holes 204*e* through which fasteners, such as screws, pins, rivets or bolts for example, can be inserted so as to secure, either permanently or removably, the adjustable foot brace 200 to the water craft 100. Any other suitable attachment method and/or structures can alternatively be employed however. In some instances, the track 204 is removably attached to the water craft 100.

Although, as noted above, some embodiments of the adjustable foot brace include an adjustment rod, the inclusion and use of the adjustment rod are optional. For example, and as disclosed herein, movement of the latch to adjust and/or lock the position of the brace element can be effected either by the hand of a user or, alternatively, through the use of an adjustment rod, when present. Thus, inclusion of the adjustment rod in the adjustable foot brace does not necessitate any changes to the configuration of the adjustable foot brace, and the principle of the operation of the adjustable foot brace remains the same regardless of whether the adjustment rod is included or not.

C. Operational Aspects of an Example Foot Brace

With particular reference now to FIGS. 10 and 11, and continuing reference to FIGS. 1-9, details are provided concerning some operational aspects of the example adjustable foot brace 200. As best shown in FIGS. 10 and 11, the tooth 206*a* of the latch 206 has a rounded leading edge, that is, the edge of the tooth 206*a* that is closest to the tie 204*b* behind which the tooth 206*a* is located. Correspondingly, the cross-sectional shape of the tie 204*b* is such that the tie 204*b* slopes downward from its leading edge to its trailing edge, that is, the edge nearest the tooth 206*a*.

In some embodiments, the latch 206 may be biased such that the tooth 206*a* tends to rotate (counterclockwise in FIG. 10) downward toward the slots 204*a* and ties 204*a* of the track 204. This biasing can be achieved, for example, by a resilient element such as a spring, and/or by weighting part of the lower portion of the latch 206, such as the tooth 206*a*. As a result of this biasing, the tooth 206*a* will tend to remain in position when it has engaged a slot 204*a*. In other instances, the tooth 206*a* will be biased into position simply by its own weight.

As a result of these complementary configurations of the tooth 206*a* and the ties 204*b*, the latch 206 is able to rotate to the orientation shown in FIG. 10. When the latch 206 is in the orientation indicated in FIG. 10, the height of the tooth 206*a* relative to the bottom of the track 204 is at a maximum. This is because the upper portion of the latch 206 is in contact with the back of the brace element 202, thus preventing further clockwise rotation of the latch 206 that could raise the tooth 206*a* higher about the bottom of the track 204.

When the latch 206 is oriented as shown in FIG. 10, the tooth 206*a* can slide over the top of the ties 204*b*. The tooth 206*a* and/or ties 204*b* may be configured so that there is a slight interference between the two and, accordingly, a small amount of resistance is presented to the user as the brace element 202 is moved toward and away from the user, discussed below.

The use of materials such as plastic, for example, in the construction of the tooth 206*a* and/or ties 204*b* may permit sufficient flex in the adjustable foot brace 200 that the tooth 206*a* can ride over the top of the ties 204*b*, notwithstanding such slight interference. To this end, relatively low friction plastics, such as those sold in connection with the trademarks Teflon® (polytetrafluoroethylene, or PTFE), or Delrin® (polyoxymethylene (POM), also known as acetal, polyacetal and polyformaldehyde), may be well suited for the contact surfaces of one or both of the tooth 206*a* and ties 204*b*. In some embodiments, aliphatic polyamides (sometimes referred to as nylon) are used for all components of the adjustable foot brace 200 except for the track 204, which may be composed of glass-filled nylon.

The aforementioned movement of the tooth 206*a* over one or more ties 204*b* can occur, for example, when the brace element 202 is being moved closer to a user seated on the seat 106, that is, when the brace element is being moved aft in the water craft 100 (or to the right in FIG. 10). As further indicated in FIG. 10, the handle 206*b* of the latch 206 is in contact with the back of the brace element 202. Where an adjustment rod is not employed, a user can effect this positioning of the handle 206*b* by using his hand to simply pull the handle 206*b* into contact with the brace element 202, at which point the brace element 202 can then be moved toward, or away from, the user as desired. The operation of embodiments that employ an adjustment rod is discussed below.

Once the brace element 202 is in a desired position, whether as a result of movement toward, or away from, the user, the handle 206B of the latch 206 can then be released so as to permit the tooth 206A to move downward toward, and engage, a slot 204A corresponding to the desired position of the brace element 202. When the tooth 206A is thus positioned, the trailing edge of the tooth 206A is located adjacent to, or abuts, a leading edge of a corresponding tie 204B positioned behind the tooth 206A. Because, as noted above, the leading edge of the tie 204B is relatively higher than the trailing edge of the tie 204B, the trailing edge of the tooth 206A cannot pass over the leading edge of the corresponding tie 204B.

Thus, once the tooth 206A has engaged a slot 204A, and the user has released the latch 206 so that the latch 206 is free to rotate, a force exerted by the foot of a user on the brace element 202 will cause the latch 206 to rotate (counterclockwise in FIG. 10) until the trailing edge of the tooth 206A contacts, and is stopped by, the leading edge of a corresponding tie 204B behind the tooth 206A. In this way, the latch 206 cooperates with the tie 204B to prevent motion of the brace element 202 away from the user once the latch 206 has been released.

The operation of embodiments that include an adjustment rod proceeds to the operation just described. More particularly, the example adjustment rod 208 is generally configured to enable positioning, by the user, of the brace element 202 in a desired location. In at least some embodiments, such positioning can be effected by simply sliding the adjustment rod 208 either toward, or away from, the user. No twisting, lifting, or other motions, of the adjustment rod 208 are necessary.

In operation, movement of the adjustment rod 208 away from the user (i.e., to the left in FIG. 10), such as may occur when the user wishes to move the brace element 202 further away from the user, causes a hook portion 208*b* of the adjustment rod 208 to contact the lower portion of the latch 206 (see, e.g., FIG. 10) so as to rotate the handle 206A of the latch 206 clockwise into contact with the brace element 202 such that at least a portion of the force exerted on the latch 206 by the hook portion 208*b* of the adjustment rod 208 is transmitted to the brace element 202. When the latch 206 is thus oriented, the tooth 206A is at its maximum height relative to the recessed portion of the track 204 and can move over the tops of the ties 204B. The user can continue to push the adjustment rod 208 until the brace element 202 has been moved to the desired position, at which time the adjustment rod 208 can be pulled slightly towards the user, allowing the tooth 206A to engage a slot 204A corresponding to the desired position. As indicated in FIGS. 10 and 11, a gap 214 enables this movement of the adjustment rod 208. Once the tooth 206A has been thus positioned, a user can use his foot to exert a force on the brace element 202 without fear of the brace element 202 moving.

In addition to enabling a user to move the brace element 202 further away from the user, the adjustment rod 208 also enables a user to move the brace element 202 relatively closer to the user. In particular, by pulling on the adjustment rod 208, the gap 214 is closed and the hook portion 208*b* of (see FIGS. 10-11) the adjustment rod 208 engages the lower portion of the brace element 202, enabling the adjustment rod 208 to pull the brace element 202 towards the user. When the adjustment rod 208 is thus positioned, the latch 206 is free to rotate and, accordingly, the tooth 206A is able to move over the tops of the ties 204B as the brace element 202 is pulled toward the user by the adjustment rod 208. Once the tooth 206A has engaged a slot 204 corresponding to the desired position of the brace 202, the adjustment rod 208 can be released by the user. The user can use his foot to exert a force on the brace element 202 without fear of the brace element 202 moving.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A watercraft comprising:

a hull;

a cockpit connected to the hull; and first and second adjustable foot braces disposed in the cockpit and connected to the hull, and each of the adjustable foot braces includes a portion that is movable to define a plurality of different foot positions, wherein each of the first and second adjustable foot braces comprises:

a track;

a brace element engaged with the track;

a latch rotatably connected to the brace element and operable to releasably engage the track in a plurality of different locations on the track; and an adjustment rod slidingly received by the track and engaged with the latch and the brace element in such a way that lifting and twisting of the adjustment rod are substantially prevented, wherein movement of the adjustment rod in a first direction moves the brace element away from a user and movement of the adjustment rod in a second direction moves the brace element toward the user, wherein the adjustment rod includes a hook portion operable to push on the latch and to pull on the brace element.

2. The watercraft as recited in claim 1, wherein the track defines a plurality of slots, each of which defines a different respective position of the brace element, and wherein the latch includes a tooth operable to releasably engage the slots defined by the track.

3. The watercraft as recited in claim 1, wherein the track comprises a plurality of ties that each include a leading edge and a trailing edge, and each tie is relatively thicker at the leading edge than at the trailing edge.

4. The watercraft according to claim 1, wherein the watercraft comprises one or more tack-offs.

5. The watercraft according to claim 1, wherein rotation of the latch to a first position permits movement of the brace element in either direction along the track, and wherein rotation of the latch to a second position prevents movement of the brace element away from a user.

6. An adjustable foot brace suitable for use with a watercraft, the adjustable foot brace comprising:

a track that is mountable to the watercraft;

a brace element including a base that engages the track, and the brace element is slidable along the track;

a latch rotatably connected to the brace element and operable to releasably engage the track in a plurality of different locations on the track, wherein rotation of the latch to a first position permits movement of the brace element in either direction along the track, and wherein rotation of the latch to a second position prevents movement of the brace in one direction along the track; and an adjustment rod slidingly received by the track and engaged with the latch and the brace element, wherein movement of the adjustment rod in a first direction moves the brace element in the first direction and movement of the adjustment rod in a second direction moves the brace element in the second direction, the second direction being opposite the first direction, wherein the adjustment rod includes a hook portion situated between the latch and the brace element and operable to push on the latch and to pull on the brace element.

7. The adjustable foot brace as recited in claim 6, wherein an upper portion of the latch includes a handle.

8. The adjustable foot brace as recited in claim 6, wherein the adjustment rod is removable from the track, and the adjustable foot brace is movable without the adjustment rod.

9. An adjustable foot brace, comprising:

a track that is mountable to a watercraft;

a brace element engaged with the track, and the brace element is slidable along the track;

a latch rotatably connected to the brace element and operable to releasably engage the track in a plurality of different locations on the track, wherein rotation of the latch to a first position permits movement of the brace element in either direction along the track, and wherein rotation of the latch to a second position prevents movement of the brace in one direction along the track, wherein an extent to which the latch is able to rotate is constrained at least in part by the brace element; and an adjustment rod slidingly received by the track and engaged with the latch and the brace element, wherein movement of the adjustment rod in a first direction moves the brace element in the first direction and movement of the adjustment rod in a second direction moves the brace element in the second direction, the second direction being opposite the first direction.

10. A watercraft, comprising:

a hull; and the adjustable foot brace as recited in claim 9, wherein the adjustable foot brace is attached to the hull.

11. The watercraft as recited in claim 10, wherein the watercraft is a kayak.

12. The watercraft as recited in claim 10, wherein the hull comprises a unitary, single-piece structure with a hollow interior.

* * * * *